US005268543A

United States Patent [19]

Ramos

[11] Patent Number: 5,268,543

[45] Date of Patent: Dec. 7, 1993

[54] LOCKING ARRANGEMENT FOR DISCONNECT SWITCH

[75] Inventor: Joel A. Ramos, Chicago, Ill.

[73] Assignee: S&C Electric Company, Chicago, Ill.

[21] Appl. No.: 852,469

[22] Filed: Mar. 17, 1992

[51] Int. Cl.[5] ..... H01H 9/28

[52] U.S. Cl. ..... 200/43.11; 200/43.01; 200/48 A; 292/148

[58] Field of Search ..... 200/43.02, 43.11, 43.19, 200/43.01, 485 B, 48 P; 292/148, 36

[56] References Cited

U.S. PATENT DOCUMENTS

| | | | |
|---|---|---|---|
| 1,260,469 | 3/1918 | Smith | 292/148 |
| 2,679,567 | 5/1954 | Kradel | 200/43.11 |
| 3,572,062 | 3/1971 | Beebe | 70/1.5 |
| 4,423,895 | 1/1984 | Mosley, Jr. | 292/148 |
| 4,489,966 | 12/1984 | Beebe et al. | 292/134 |
| 4,669,589 | 6/1987 | Rogers | 192/14 |
| 4,986,578 | 1/1991 | Hall | 292/104 |

OTHER PUBLICATIONS

Descriptive Bulletin 719-30 dated Nov. 13, 1989, S&C Electric Company.

Instruction Sheet 761-500 dated Feb. 11, 1985, S&C Electric Company.

Instruction Sheet 761-535 dated Jul. 23, 1990, S&C Electric Company.

*Primary Examiner*—Renee S. Luebke

*Attorney, Agent, or Firm*—James V. Lapacek

[57] ABSTRACT

An arrangement for locking the disconnect linkage of a high-voltage switch is provided that includes two relatively movable locking members that are each moved between locked and unlocked positions in response to operation of the disconnect linkage. As the disconnect linkage is moved to an opened position, the two locking members are moved into relative overlapping alignment to receive a blocking member to prevent movement of the disconnect linkage. One locking member is carried by the disconnect linkage and the second member is carried by a pivotally mounted support arm that is affixed to the disconnect linkage so as to move therewith. Accordingly, the second locking member does not encroach on the space adjacent the disconnect linkage except when it is moved into alignment in the opened position. The support arm that carries the second locking member is arranged to guide the disconnect linkage and prevents undesirable movement of the disconnect linkage due to transverse forces on the disconnect linkage during movement between the opened and closed positions.

16 Claims, 2 Drawing Sheets

LOCKING ARRANGEMENT FOR DISCONNECT SWITCH

FIELD OF THE INVENTION

The present invention relates generally to the field of locking arrangements and more particularly to a locking arrangement to lock a manual disconnect linkage of a high-voltage switch in an opened position.

DESCRIPTION OF THE RELATED ART

Various locking arrangements are known for the operating handles and decoupling mechanisms of the linkages on electrical switches as well as enclosures for electrical apparatus such as pad-mounted gear and switchgear. For example, see U.S. Pat. Nos. 4,669,589, 3,572,062, 4,986,578, and 4,489,966. Additionally, see the following publications by S&C Electric Company: Descriptive Bulletin 719-30 (dated Nov. 13, 1989) for S&C Switch Operators Type CS-1A and Instruction Sheets 761-535 (page 7) dated Jul. 23, 1990 and 761-500 (page 7) dated Feb. 11, 1985 for S&C Alduti-Rupter Switches.

While these arrangements are suitable for their intended use, they are neither adaptable to nor desirable for the disconnect linkage of a high-voltage switch.

SUMMARY OF THE INVENTION

Accordingly, it is a principal object of the present invention to provide a locking arrangement for the disconnect linkage of an electrical switch wherein the disconnect linkage utilizes a support arm that carries a first locking member which cooperates with a second locking member that is carried by the disconnect linkage to receive a blocking member so as to prevent movement of the disconnect linkage out of an opened position.

It is another object of the present invention to provide a locking arrangement for the disconnect linkage of an electrical switch which includes two cooperating members and which is configured so as to minimize the force required to move the disconnect linkage under icing conditions.

These and other objects of the present invention are efficiently achieved by an arrangement for locking the disconnect linkage of a high-voltage switch in an open position via the provision of two relatively movable locking members that are each moved between locked and unlocked positions in response to operation of the disconnect linkage. As the disconnect linkage is moved to an opened position, the two locking members are moved into relative overlapping alignment to receive a blocking member to prevent movement of the disconnect linkage out of the opened, locked position. One locking member is carried by the disconnect linkage and the second member is carried by a pivotally mounted support arm that is affixed to the disconnect linkage so as to move therewith. Accordingly, the second locking member does not encroach on the space adjacent the disconnect linkage except when it is moved into alignment in the opened position. The support arm that carries the second locking member is arranged to guide the disconnect linkage and prevents undesirable movement of the disconnect linkage due to transverse forces on the disconnect linkage during movement between the opened and closed positions.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
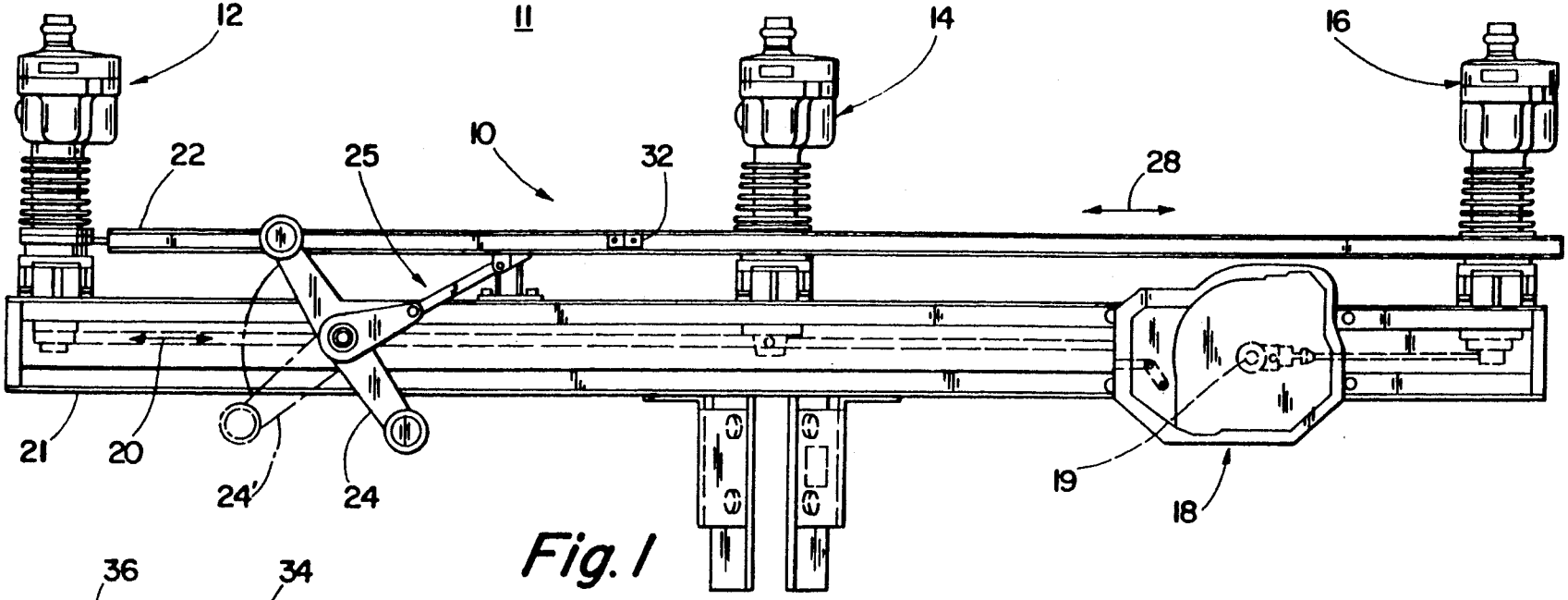
FIG. 1 is a front elevational view of an electrical switch utilizing the locking arrangement of the present invention.

The locking arrangement 10 of the present invention is illustrated in FIG. 1 for use with a high-voltage switch 11. The high-voltage switch 11 includes a plurality of switch-pole units 12, 14, and 16. An operating mechanism 18 via a drive output shaft 19 operates an interrupter drive train generally referred to at 20. The interrupter drive train 20 is a high-speed drive train or linkage that is coupled to operate an interruption function of each of the switch-pole units 12,14 and 16 between opened and closed positions. The switch-pole units 12,14 and 16 are rotatably mounted with respect to a support member 21 which also supports the operating mechanism 18.

Each of the switch-pole units 12,14 and 16 is also operable to perform a disconnect function via a disconnect linkage 22 to provide a visible air gap. The disconnect linkage 22 is operable via a manual crank arm 24; i.e., by way of an insulated switch stick or the like. Suitable linkage elements generally referred to at 25 couple movement of the crank arm 24 to displace the disconnect linkage 22 along the path referred to by arrow 28. Operation of the crank arm 24 provides opening and closing of the disconnect feature via movement of the switch-pole units 12, 14 and 16. For example, the disconnect feature is illustrated in FIG. 1 in the closed position, while the open position is achieved by movement of the crank arm 24 to the position 24' shown in phantom in FIG. 1.

In accordance with common work practice, a visible air gap such as an open disconnect is required for operating personnel to perform work on the lines or equipment downstream of the switch 11. In this regard, the locking arrangement 10 of the present invention is operable to lock the disconnect linkage 22 and the crank arm 24 in the open position such that the switch-pole units 12,14 and 16 cannot be moved to the closed position. Thus, the locking arrangement 10 is useful to preserve the visible air gap and suitable working conditions.

Figure 4:
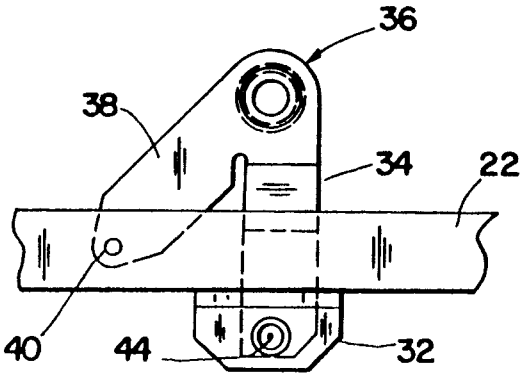
FIG. 4 is a top plan view similar to FIG. 3 but illustrating the open, locked position.
Figure 5:
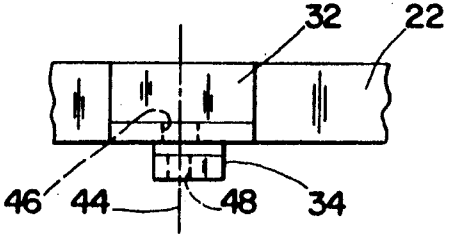
FIG. 5 is a front elevational view of a portion of FIG. 4.

Referring now additionally to FIGS. 2–5, the locking arrangement 10 includes a first locking member 32 affixed to and movable with the disconnect linkage 22 and a second locking member 34 carried by a support 36 that is pivotally mounted with respect to the tubular support member 21. The support 36 includes an arm 38 that is pivotally attached to the disconnect linkage 22 via a pivot pin 40 so as to be movable with and to follow the position of the disconnect linkage 22. The first and second locking members 32 and 34 are arranged with respect to the disconnect linkage 22 such that the members 32 and 34 are aligned in the open disconnect position, one above the other, such that a blocking member as represented at 44 can be placed through the apertures 46,48 respectively of the members 32,34 as illustrated in FIGS. 4 and 5. The support 36 provides guidance for the disconnect linkage 22 and stability against transverse forces that may be applied to the disconnect linkage 22 during operation of the crank arm 24.

Figure 3:
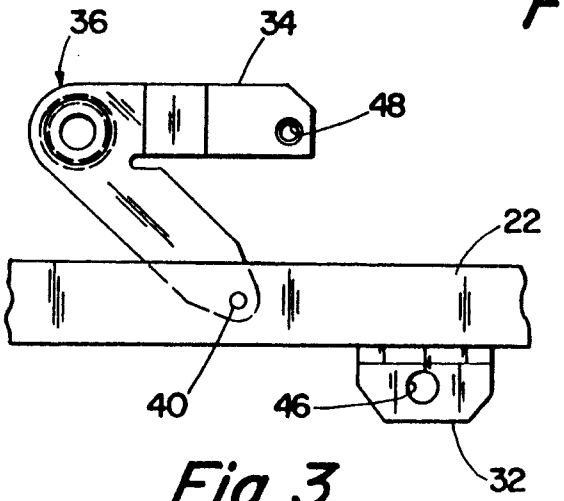
FIG. 3 is a top plan view of portions of the switch of FIG. 1 illustrating the locking arrangement in the closed, unlocked position.

During operation, as the crank arm 24 is pivoted from the closed position of FIG. 3 to the open position of FIG. 4, the first member 32 is displaced along with the disconnect linkage 22 to the position of FIG. 4 and the second locking member 34 is pivoted into alignment with the first member 32. In the position of FIG. 4, the blocking member at 44 is inserted through the apertures 46,48 of the members 32,34. In that open, locked position, if it is attempted to move the crank arm 24 away from the open position, it can be seen that this is prevented since it is geometrically impossible for the disconnect linkage 22 to move to the right in FIG. 4 without pivoting of the support 36; i.e., either of the members 32,34 can be moved. The support 36 cannot pivot since pivoting would require elongation of the rigid member 34 in order to move out of the locked position.

In accordance with important features of the present invention, the configuration of the locking arrangement 10 provides for desirable separation of the two locking members 32,34 in relative positions other than the open, locked position. Further, movement of the second member 34 includes a vectorial component that is transverse relative to the movement of the first member 32 with the transverse vectorial component increasing as the disconnect linkage 22 moves toward the closed position. Thus, as the disconnect linkage 22 moves out of the open, locked position and toward the closed position, the two locking members first move generally in the same direction and then in increasingly different directions as the transverse vectorial component increases. This configuration is advantageous when the electrical switch 10 is exposed to icing conditions due to the fact that when the disconnect linkage 22 is in the closed position and the disconnect linkage will be required to open the electrical switch, the two locking members are at their widest separations so as not to exacerbate the opening requirements.

Additionally, when the disconnect linkage 22 is in the open position and the two locking members 32,32 are in the aligned position for locking the disconnect linkage 22, the relative movement of the two locking members as the disconnect linkage is moved out of the open position minimizes the problems of ice-breaking to separate the two locking members. During initial relative movement, the two locking members pivot or rotate away from each other to break up any ice buildup as opposed to an arrangement where the two locking members move apart in linear or shear fashion.

Figure 7:
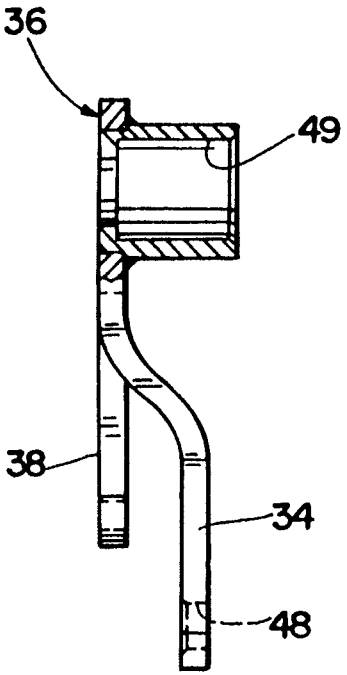
FIG. 7 is a right elevational view, partly in section, of the support arm of FIG. 6.
Figure 6:
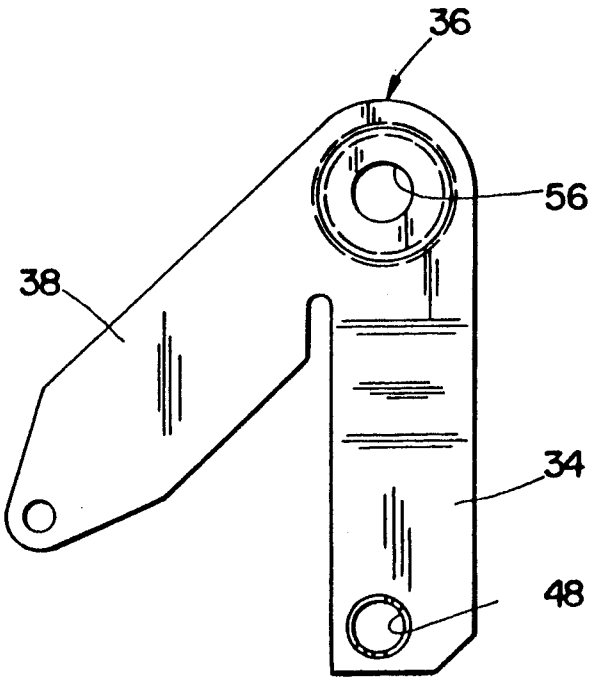
FIG. 6 is a top plan view of a support arm of the arrangement of FIGS. 1 and 2.
Figure 2:
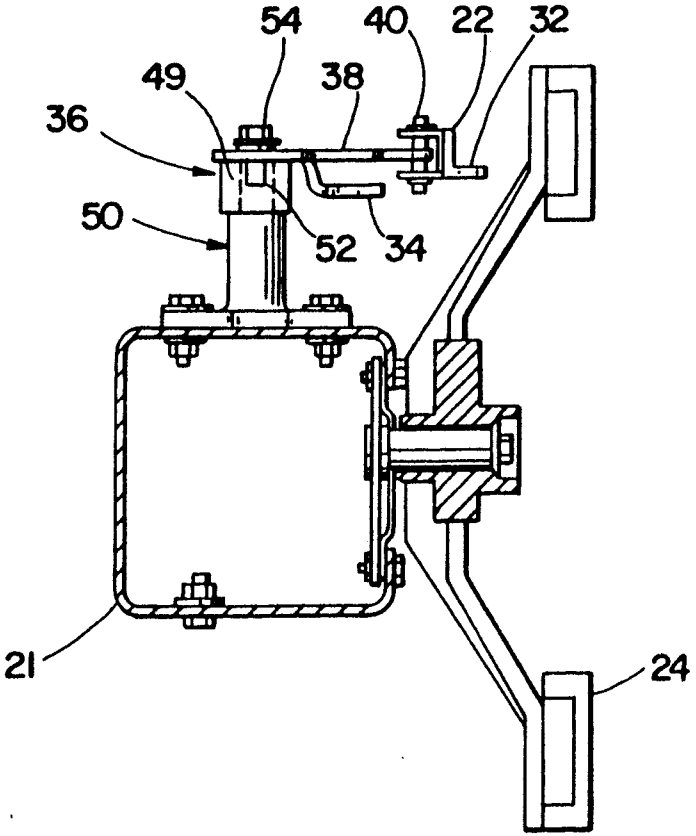
FIG. 2 is a left side elevational view, partly in section and with parts removed, of FIG. 1.

Referring additionally now to FIGS. 6–7, the support 36 includes a sleeve portion 49 that is positioned onto an upstanding member 50 (FIG. 2) that is rigidly attached to the tubular support member 21. The upstanding member 50 includes a threaded sleeve portion 52 (FIG. 2). A bolt or other threaded fastener 54 (FIG. 2) is placed through an aperture 56 (FIG. 6) in the support 36 and threaded into the member 50 so as to permit pivoting of the support 36 with respect to the upstanding member 50.

In accordance with further aspects of the use of the present invention, a tagging device (not shown) including suitable features to provide the blocking member at 44 may be utilized. An illustrative example of such a tagging device is the TD Tagging Device available from the Salisbury Co. of Skokie, Ill. Such a tagging device is adapted to fit over the end of a switch stick (not shown) so that an extending hook portion of the tagging device may be inserted as a blocking member at 44 through the aligned apertures 46,48 of the locking members 32,34. The tagging device includes provisions for the attachment of a suitable HOLD card or the like to serve as notice that the disconnect feature of the switch 11 is not to be closed until the "clearance" has been released by appropriate personnel. Thus, the use of such a tagging device serves as a blocking member to maintain the locking arrangement in the opened position and also serves the function of an indicator. Of course, considering another illustrative example, the shackle of a padlock (not shown) may be utilized as the blocking member represented at 44.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A locking arrangement for an electrical switch that includes a disconnect linkage movable between closed and opened positions along a predetermined path, the locking arrangement comprising:

a first locking member carried by the disconnect linkage so as to be movable therewith between predetermined positions corresponding to the closed and opened positions of the disconnect linkage; and means drivingly coupled to the disconnect linkage so as to be driven in response to movement of the disconnect linkage and carrying a second locking member for moving said second locking member to a predetermined position in response to the disconnect linkage being moved to the opened position and for moving said second locking member out of said predetermined position in response to the disconnect linkage being moved out of the opened position, said first locking member and said second locking member being aligned in predetermined relationship when the disconnect linkage is in the opened position.

2. The locking arrangement of claim 1 wherein each of said first and second locking members includes means for defining cooperating features that are aligned when the disconnect linkage is in the opened position.

3. The locking arrangement of claim 1 wherein said first and second locking members each include an aperture formed therethrough, said apertures being aligned when the disconnect linkage is in the opened position.

4. The locking arrangement of claim 1 wherein said moving means comprises support means for providing a pivotal support with respect to the disconnect linkage and means extending from said support means and being pivotally connected to the disconnect linkage.

5. The locking arrangement of claim 4 wherein said second locking member extends from said support means at a predetermined angle with respect to said extending means.

6. The locking arrangement of claim 1 wherein said moving means comprises means for defining relative movement between said second locking member and said first locking member that includes a first vectorial component that is transverse to said first locking member as the disconnect linkage is moved out of the opened position and toward the closed position.

7. The locking arrangement of claim 6 wherein said relative-movement-defining means comprises means for pivotally supporting said second locking member in a predetermined relative position with respect to said first locking member.

8. The locking arrangement of claim 6 wherein said relative-movement-defining means defines said relative movement such that said first vectorial component increases as the disconnect linkage is moved toward the closed position.

9. A locking arrangement for a disconnect linkage that operates an electrical switch between closed and opened positions and that is movable between closed and opened positions along a predetermined path, the locking arrangement comprising a first member extending from and carried by the disconnect linkage and first means carrying a second member and being interconnected with the disconnect linkage so as to be movable in response to movement of the disconnect linkage for defining movement of said second member into an aligned position with said first member when the disconnect linkage is in an opened position and for defining movement of said second member away from said first member when the disconnect linkage is moved out of the opened position and toward a closed position.

10. The locking arrangement of claim 9 wherein said first means comprises means for moving said second member relative to said first member as the disconnect linkage is moved out of the opened position and toward the closed position such that the relative movement of said second member with respect to said first member includes a first vectorial component of movement in a direction transverse to the direction of movement of the disconnect linkage.

11. A locking arrangement for an electrical switch that includes a disconnect linkage movable between closed and opened positions along a predetermined path, the locking arrangement comprising:

a first locking member carried by the disconnect linkage so as to be movable therewith between predetermined positions corresponding to the closed and opened positions of the disconnect linkage; and means movable in response to movement of the disconnect linkage and including a second locking member for moving said second locking member to a predetermined position when the disconnect linkage is moved to the opened position and for moving said second locking member out of said predetermined position when the disconnect linkage is moved out of the opened position, said first locking member and said second locking member being aligned in predetermined relationship when the disconnect linkage is in the opened position, said moving means comprising support means for providing a pivotal support with respect to the disconnect linkage and means extending from said support means and being pivotally connected to the disconnect linkage.

12. The locking arrangement of claim 11 wherein said second locking member extends from said support means at a predetermined angle with respect to said extending means.

13. A locking arrangement for an electrical switch that includes a disconnect linkage movable between closed and opened positions along a predetermined path, the locking arrangement comprising:

a first locking member carried by the disconnect linkage so as to be movable therewith between predetermined positions corresponding to the closed and opened positions of the disconnect linkage; and means movable in response to movement of the disconnect linkage and including a second locking member for moving said second locking member to a predetermined position when the disconnect linkage is moved to the opened position and for moving said second locking member out of said predetermined position when the disconnect linkage is moved out of the opened position, said first locking member and said second locking member being aligned in predetermined relationship when the disconnect linkage is in the opened position, said moving means comprising means for defining relative movement between said second locking member and said first locking member that includes a first vectorial component that is transverse to said first locking member as the disconnect linkage is moved out of the opened position and toward the closed position.

14. The locking arrangement of claim 13 wherein said relative-movement-defining means comprises means for pivotally supporting said second locking member in a predetermined relative position with respect to said first locking member.

15. The locking arrangement of claim 13 wherein said relative-movement-defining means defines said relative movement such that said first vectorial component increases as the disconnect linkage is moved toward the closed position.

16. A locking arrangement for a disconnect linkage that operates an electrical switch between closed and opened positions and that is movable between closed and opened positions along a predetermined path, the locking arrangement comprising a first member extending from and carried by the disconnect linkage and first means including a second member and being movable in response to movement of the disconnect linkage for defining movement of said second member into an aligned position with said first member when the disconnect linkage is in an opened position and for defining movement of said second member away from said first member when the disconnect linkage is moved out of the opened position and toward a closed position, said first means comprising means for moving said second member relative to said first member as the disconnect linkage is moved out of the opened position and toward the closed position such that the relative movement of said second member with respect to said first member includes a first vectorial component of movement in a direction transverse to the direction of movement of the disconnect linkage.

* * * * *